United States Patent [19]

Brienza et al.

[11] 4,385,573

[45] May 31, 1983

[54] SINGLE ACTUATOR CONTROL OF MULTIPLE SEWING INSTRUMENTALITIES

[75] Inventors: Michael J. Brienza, Ridgewood; Peter J. Totino, North Bergen, both of N.J.

[73] Assignee: The Singer Company, Stamford, Conn.

[21] Appl. No.: 262,167

[22] Filed: May 11, 1981

[51] Int. Cl.[3] ..... D05B 3/02

[52] U.S. Cl. ..... 112/158 E

[58] Field of Search ..... 112/158 E, 158 R, 158 A, 112/158 B, 158 D, 121.11, 220

[56] References Cited

U.S. PATENT DOCUMENTS

| | | | |
|---|---|---|---|
| 3,976,019 | 8/1976 | Allen et al. . | |
| 3,984,745 | 10/1976 | Minalga . | |
| 4,016,441 | 4/1977 | Herr et al. . | |
| 4,074,642 | 2/1978 | Herr . | |
| 4,143,606 | 3/1979 | Herr et al. | 112/158 E |
| 4,336,762 | 6/1982 | Giolitti | 112/158 E |

*Primary Examiner*—Peter P. Nerbun

*Attorney, Agent, or Firm*—David L. Davis; Robert E. Smith; Edward L. Bell

[57] ABSTRACT

A mechanism in a sewing machine wherein two or more stitch forming instrumentalities may be individually actuated independent of all other stitch forming instrumentalities by a single actuator.

10 Claims, 6 Drawing Figures

SINGLE ACTUATOR CONTROL OF MULTIPLE SEWING INSTRUMENTALITIES

DESCRIPTION

BACKGROUND OF THE INVENTION

This invention relates to electronic sewing machines of the type wherein two or more stitch forming instrumentalities may be individually actuated independent of all other stitch forming instrumentalities.

Sewing machines are known wherein the positional coordinates for successive stitch penetrations are stored in an electronic memory having addressable locations corresponding to a plurality of operator selectable patterns. Such known sewing machines include logic circuitry which is used to select and release the stitch pattern information stored in the memory in timed relation with the operation of the sewing machine. Digital information from the memory is converted to positional analog signals which control closed loop servo systems including moving coil linear or rotary actuators directly controlling the position of conventional stitch forming instrumentalities of the sewing machine to reproduce a pattern of stitches corresponding to the selected stitch information. See for example, U.S. Pat. No. 4,074,642, Feb. 21, 1978, Herr and U.S. Pat. No. 3,984,745, Oct. 5, 1976, Minalga, the teachings of which are incorporated herein by reference. Positional sensing devices provide feed back within the closed loop servos, as disclosed in U.S. Pat. No. 3,976,019, Aug. 24, 1976, Allen et al, the teachings of which are incorporated herein by reference. Typically, two or more actuators are used in these sewing machines, a unique actuator dedicated to each individually controllable stitch forming instrumentality. These actuators, however, are heavy, bulky, and expensive to manufacture. It is therefore an object of the present invention to utilize a single actuator to individually control a plurality of stitch forming instrumentalities.

SUMMARY OF THE INVENTION

The foregoing and additional objects and advantages of the invention will become apparent through reference to the accompanying drawings and descriptive matter which illustrate a preferred embodiment of this invention.

According to the present invention there is provided an electronically controlled stitch pattern sewing machine including a plurality of stitch forming instrumentalities at least two of which are each positionally controllable over a predetermined range.

A plurality of coupling means are included for imparting selected predefined movements to at least two of the controllable stitch forming instrumentalities.

A single actuator and control means for selectively and individually coupling the single actuator to each of the coupling means is provided, whereby the selected predefined movements of the controllable stitch forming instrumentalities are effected by the single actuator.

BRIEF DESCRIPTION OF THE DRAWINGS

In order that the invention be more fully understood it will be described by way of example with reference to the accompanying drawings in which.

DETAILED DESCRIPTION OF THE INVENTION

Figure 1:
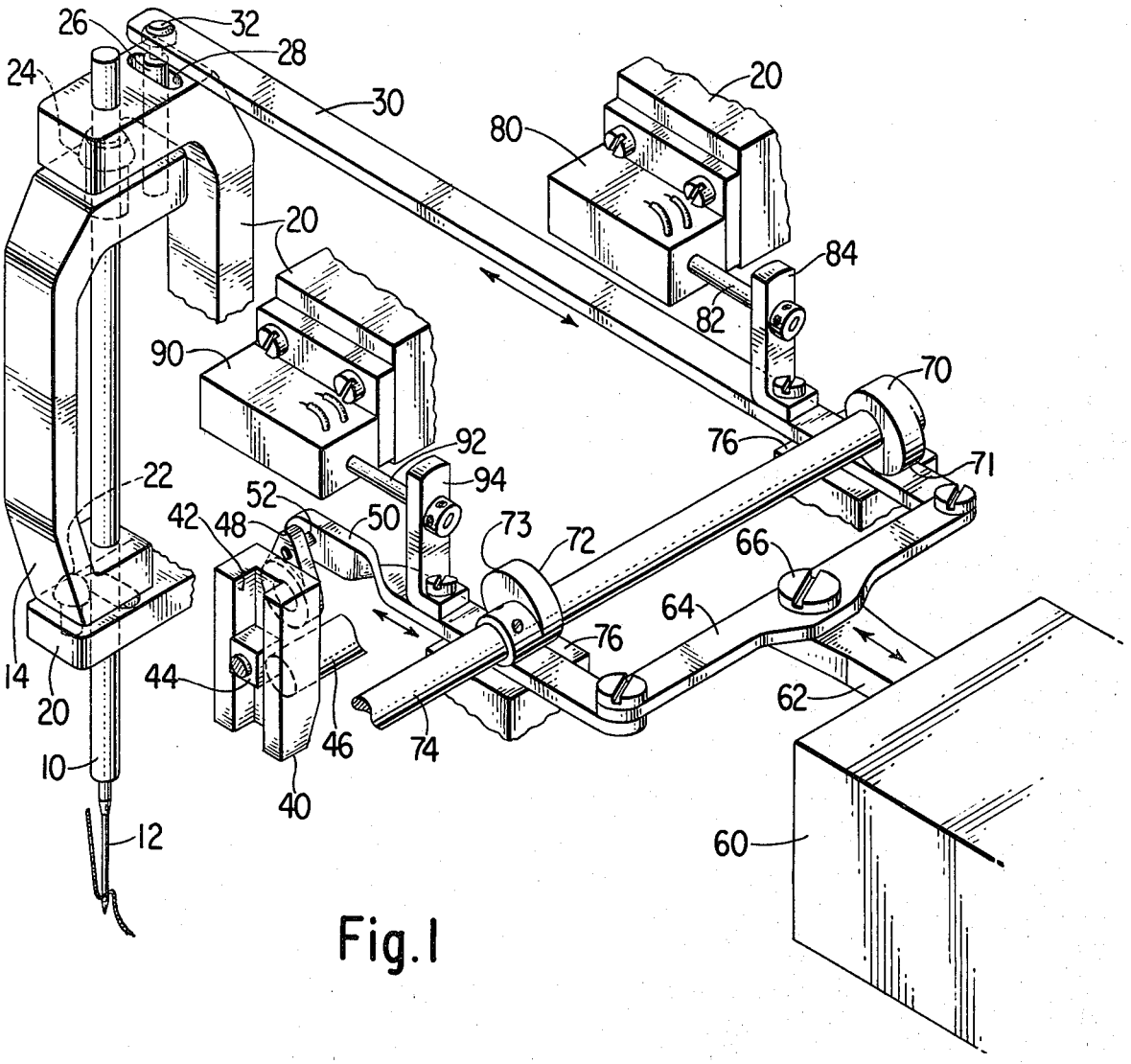
FIG. 1 is a partial perspective view of selected stitch forming instrumentalities of a sewing machine showing one embodiment of the present invention.

Referring to FIG. 1, there is shown a needle bar 10 having a thread carrying needle 12 supported in one end thereof and a needle bar gate 14 arranged to support the needle bar 10 for endwise reciprocation. The needle bar gate 14 is supported in the frame 20 at its lower extremity by a spherical ball joint 22 and at its upper extremity by a spherical bearing collar 24 such that as the needle bar gate is pivoted about these two spherical supports a jogging motion is imparted to the needle bar 10. A drive pin 26 projecting upwardly from the upper extremity of the needle bar gate 14 projects through a clearance slot 28 in the frame 20 and is pivotally attached to a push rod 30 at a pivot point 32. Longitudinal motion of the push rod 30 will cause the needle bar gate 14 to pivot about the spherical supports 22 and 24 thereby imparting jogging motion to the needle bar 19. The above description relates only one of many ways in which a needle bar may be mounted for reciprocating motion as well as jogging motion. Such structure is well known in the prior art and will not be described further here.

A feed control block 40 having a vertical slot 42 and slide block 44 is pivotally mounted to the frame 20 by a pivot shaft 46. A bell crank arrangement 48 rigidly attached to the feed control block 40 is pivotally connected to a push rod 50 by a pin 52. As the push pin 50 undergoes longitudinal motion, the feed control block 40 is angularly positioned relative to the pivot shaft 46. The slide block 44 is attached to the feed mechanism (not shown) in a notoriously well known manner. The angular positioning of the feed control block 40 is arranged to limit or control the amount of feed and direction of feed through the slide block 44. This feed control mechanism is also well known in the art and its detailed structure is not pertinent to the successful practice of this invention.

A linear actuator 60 having a low inertia armature exhibiting high acceleration characteristics is rigidly mounted to the sewing machine frame 20. The actuator is capable of very precise positioning of the armature. See U.S. Pat. No. 4,016,441, Apr. 5, 1977, Herr et al. for a more detailed description of the structure of this type of actuator, the teachings of which are incorporated herein by reference. The drive link 62 coupled to the armature of the actuator 60 is constrained to move in a longitudinal direction along with the armature. An elongated differential bar 64 has two extremities, the first of which is pivotally attached to the extremity of the push rod 30 which is opposite the pivot pin 32 and the other end of which is pivotally attached to the extremity of the push rod 50 which is opposite the pivot pin 52. The drive link 62 is pivotally attached at 66 to the elongated differential bar 64 between its two extremities. A pair of brake cams 70, 71 are rigidly attached to a brake shaft 74 which is journalled in the frame 20 for rotation. The brake shaft 74 is driven in timed relation to the arm shaft (not shown). The brake cams 70, 72 are arranged so that their respective high lobes 71 and 73, when positioned towards the push rods 30, 50 will wedge the push rods against the pressure pads 76 which are rigidly attached to the frame 20. The high lobes 71 and 73 of the brake cams 70 and 72 are 180° out of phase so that when the brake cam 70 has wedgingly engaged the push rod 30 thereby restraining it from moving, the other brake cam 72 has its high lobe 73 positioned away from the push rod 50 permitting motion thereof. As the brake shaft 74 rotates, the brake cam 70 disengages the push rod 30 and the brake cam 72 then wedgingly engages the push rod 50 thereby permitting the push rod 30 to move freely. This alternate braking and releasing of the push rods 30 and 50 continues in timed relation with the rotation of the arm shaft and effectively connects the single actuator by turns to each of the push rods. In this way, the push rod 30 will be effective for positioning the bight of the needle during a time interval that is associated with a specific segment of arm shaft rotation and the push rod 50 will be effective for positioning the feed regulator shaft during a time interval that is associated with a different segment of arm shaft rotation. A pair of position sensors 80, 90, each having a wiper actuated by a rod 82, 92, are rigidly mounted to the frame 20 by suitable fasteners. A pair of angle brackets 84, 94, one rigidly mounted to the push rod 30 and the other rigidly mounted to the push rod 50, are arranged to operatively engage the wiper push rods 82, 92 of the position sensors 80 and 90. As the push rods 30 and 50 move longitudinally, so do their respective wiper rods 82 thereby generating positional data for both push rods. This positional data is then fed back to the closed loop servo system for controlling the actuator 60. The brake cams and associated brake shaft, the position sensors, the angle brackets, and the elongated differential bar, comprise a control means, the function of which is to selectively and individually couple the armature of the linear actuator to each of the push rods, or coupling means, for individual actuation of the needle bar gate, and the feed control mechanism.

In operation, while the needle is out of the work material, the brake shaft is rotated to a position when the push rod 50, which couples the feed control mechanism to the control means, is constrained from movement. In this position, the push rod 30, which couples the needle bar gate to the control means, is free to move in a longitudinal direction. The position sensor 90 is electrically switched out of the closed loop servo circuit and the position sensor 80 is switched in for controlling the linear actuator while positioning the needle bar gate. After positioning the needle bar gate in accordance with needle positioning coordinates stored in memory for a selected stitch pattern, the brake shaft is again rotated, this time until the push rod 30 is constrained from movement thereby locking the needle bar gate in the selected position and releasing the push rod 50. The position sensor 80 is electrically switched out of the closed loop servo circuit and the position sensor 90 is switched in for controlling the linear actuator while positioning the feed control mechanism.

Stitch pattern data is stored in the electronic memory 500 (ROM) in partitioned data blocks. For a given stitch pattern there is a group of each data blocks containing information for controlling needle bight and another group of data blocks containing information for controlling the amount of work feed. Data stored in a specific one data block represents movement of either the needle bar or the feed mechanism but not both. A multiplexer 502 alternately switches the bight and feed data to line 504 in timed relation with the rotation of the arm shaft utilizing the control logic unit 508. For each rotation of the arm shaft both bight and feed data are alternately impressed upon line 504. The bight or feed data impressed upon line 504 is processed in the actuator control system 506 which effects movement of the needle bar gate via the push rod 30 or movement of the feed regulator mechanism via push rod 50. The bight position sensor 80 which senses the position of the push rod 30 and the feed position sensor 90 which senses the position of the push rod 50 both present positional feedback data to the multiplexer 510 which is then returned via line 512 to the actuator control system 506 to complete the closed loop servo system. The multiplexer 510 under the influence of the control logic 508, alternately switches the bight position feedback data or the feed position feedback data in phase with the multiplexer 502. Therefore, when bight data is impressed upon line 504 for processing by the actuator control system 506 the multiplexer 510 will switch bight position feedback data from the bight position sensor 80 to the actuator control system 506. Within the actuator control system 506 appropriate signals will be applied to the actuator 60 for positioning the push rod 30. During this positioning of the push rod 30 the high lobe 73 of the brake cam 72 is in wedging engagement with the push rod 50 while the brake cam 70 is positioned so that the push rod 30 is free to move. When the needle bar is positioned in accordance with the bight data contained in the ROM 500 the control logic 508 causes the multiplexer 502 to impress feed data upon line 504 for processing by the actuator control system 506. Similarly, the output of the feed position sensor 90 is switched by the multiplexer 510 to the line 512, the brake cam 70 is positioned in wedging engagement with the push rod 30 and the brake cam 72 is positioned so that the push rod 50 is free to move. The push rod 50 is then positioned in accordance with the feed data contained in the ROM 500 in a manner similar to that described above for positioning the push rod 30. A more detailed description of the logic structure and operation of the actuator control system including manual bight and feed controls, bight and feed logic; digital to analog converters, amplifiers, and the servo closed loop system may be found in the referenced U.S. Pat. No. 3,984,745.

For a more detailed description of how needle positional coordinates are stored in memory and retrieved therefrom see U.S. Pat. Nos. 4,074,642 and 3,976,019 as referenced above.

With the above described arrangement, selected predefined movements of at least two stitch forming instrumentalities, such as the needle bar gate and the feed regulator mechanism, are effected successively by a single actuator. Such successive predefined movements for a given instrumentality are mutually exclusive.

The brake cam and shaft arrangement described above is for illustrative purposes only. Alternative brake means such as solenoid operated disc or drum brakes or the like will be readily devised by the skilled art worker, the specific structure of which is not pertinent to the successful practice of this invention.

Figure 2:
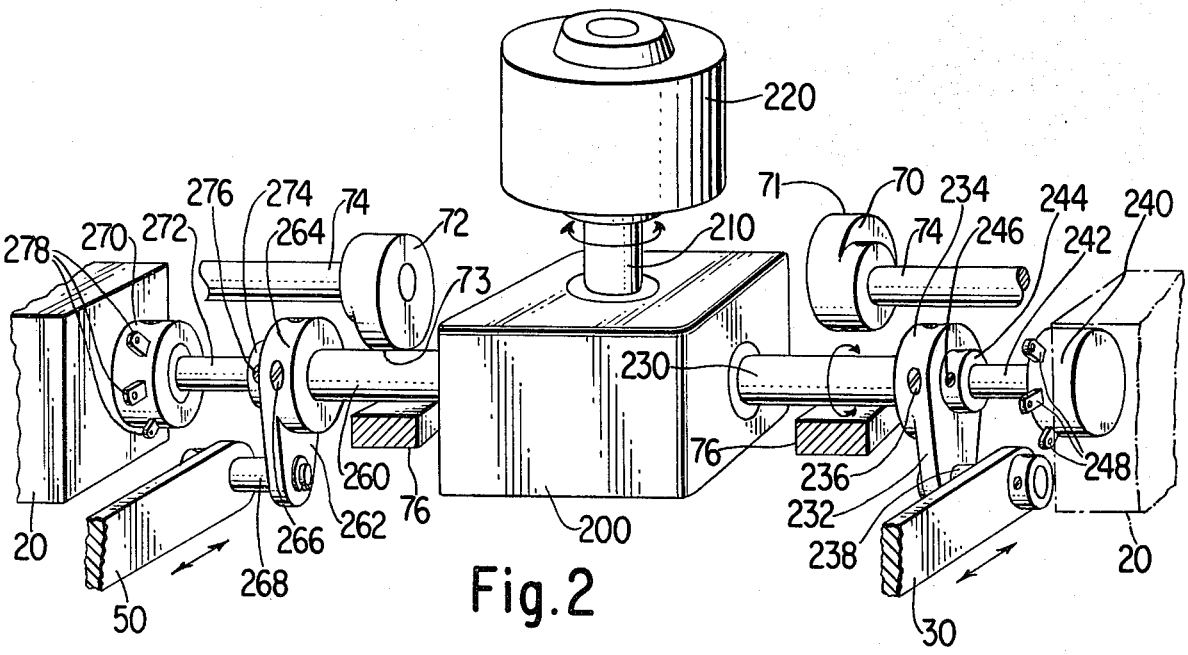
FIG. 2 is similar to FIG. 1 but showing another embodiment of the present invention.

Referring to FIG. 2, there is shown a second embodiment of the present invention. A differential gear assembly 200 rigidly secured to the frame 20, is utilized having an input shaft 210 to which is coupled a rotary actuator 220 for imparting selected rotary motion thereto and two output shafts, 230 and 260. The operation of the differential gear assembly 200 is notoriously well known in the art. When the input shaft of such a mechanism is rotated in a given direction and both output shafts are free to rotate, they will do so in the same direction and at a given angular velocity relative to the input shaft. If one of the output shafts is constrained from rotation, the other output shaft will simply rotate in the original direction at a speed greater than its original speed. This characteristic is exploited in the present invention and its use will be described in more detail below.

One end of a crank 232 having a boss 234 is rigidly fastened to the free extremity of the output shaft 230 by the set screw 236. A pivot pin 238 pivotally couples the other end of the crank with one end of a push rod 30, the other end of which is operationally coupled to the needle bar gate as described in the first embodiment of the present invention. A potentiometer 240 for sensing the angular displacement of the output shaft 230 is rigidly attached to the frame 20. The wiper shaft 242 of the potentiometer 240 is arranged to engage the bore of a collar 244 which is secured, by suitable means, to the crank 232. A set screw 246 rotationally couples the collar 244 and the wiper shaft 242. As the output shaft 230 rotates, the crank 232 will impart an approximately linear movement to the push rod 30 which in turn will position the needle bar gate. As the crank 232 rotates, so does the wiper shaft 242 thereby generating data which represents the position of the push rod 30. This positional data is then fed back to the closed loop servo system, as described above, in the first embodiment, for controlling the actuator 220.

Similarly, the output shaft 260 is rotationally coupled to a potentiometer 270 via a crank 262, a collar 274, set screws 266 and 276, and a wiper shaft 272. A pivot pin 268 pivotally couples the crank 262 with one end of a push rod 50, the other end of which is operationally coupled to the feed mechanism of the sewing machine as described above in the first embodiment of the present invention.

Additionally, as described in the first embodiment, a pair of brake cams 70, 71 are rigidly attached to a brake shaft 74 which is journalled in the frame 20 for rotation. The brake cams 70, 72 are arranged so that their respective high lobes 71 and 73, when positioned towards the output shafts 230, 260, will wedge the shafts 230, 260 against pressure pads 76 which are rigidly attached to the frame 20. As in the first embodiment, the high lobes 71 and 73 are 180° out of phase.

In operation, the second embodiment functions very much like the first embodiment. The output shafts 230, 260 are alternately braked and released by the brake cams in timed relation to the rotation of the arm shaft of the sewing machine. The position sensors 240, 270 are alternately switched into and out of the closed loop servo circuit in correspondence to the alternate releasing and braking of the output shafts 230 and 260. The control means comprising the brake cams and associated brake shaft, the differential gear assembly, the potentiometers, and the cranks, selectively and individually couple the shaft 210 of the actuator to each of the push rods 30, 50, or coupling means, for individual actuation of the needle bar gate and the feed control mechanism.

Figure 3:
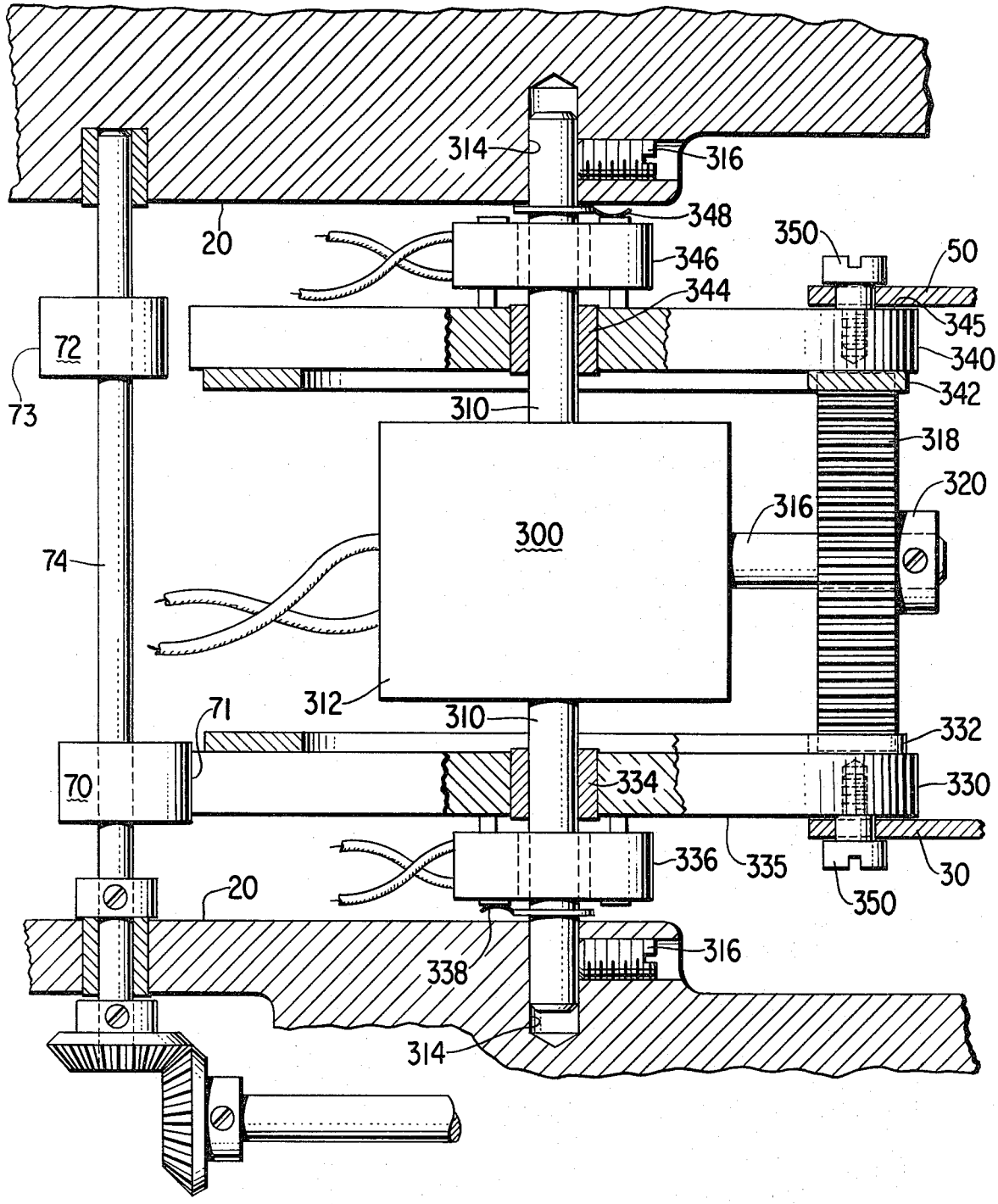
FIG. 3 is a partial section view showing another embodiment of the present invention.

Referring to FIG. 3, there is shown a third embodiment of the present invention. A motor 300 having its armature shaft 310 extending beyond the motor housing 312 in both directions, is arranged so that each end of the armature shaft engages coaxial holes 314 bored in the frame 20. A pair of set screws 316 lock the armature shaft 310 to the frame 20. A stud 316, rigidly attached to the motor housing 312, has rotationally attached to its free extremity a gear 318 which is retained in place by collar 320 but is permitted to freely rotate with respect to the stud 316. A pair of face gears 330 and 340 being rotationally journalled on the shaft 310 with bushings 334 and 344 are arranged with their respective gear teeth 332 and 342 in working engagement with opposite sides of the gear 318. That is, the face gear 330 is journalled on the shaft 310 on one side of the actuator 300 with the teeth 332 facing the gear 318 and the face gear 340 is journalled on the shaft 310 on the other side of the actuator 300 with its teeth 342 also facing the gear 318. The two face gears are constrained from side to side motion by conventional means, not shown. One extremity of the push rod 30 is pivotally attached to the outside face 335 of the face gear 330 by a shoulder screw 350. Similarly, the push rod 50 has one extremity pivotally attached to the outside face 345 of the face gear 340 by a shoulder screw 350. The other extremities of the push rods 30 and 50 are coupled to the needle bar gate and to the feed mechanism of the sewing machine respectively, as is described in the first embodiment. A potentiometer 336 for sensing the angular displacement of the face gear 330 is rigidly attached thereto. A wiper 338 of the potentiometer 336 is rigidly and electrically connected to the shaft 310, thus, as the face gear 330 rotates, so does the potentiometer 336. Similarly, a potentiometer 346 for sensing the angular displacement of the face gear 340 is rigidly attached thereto and has a wiper 348 mechanically and electrically connected to the shaft 310.

Additionally, as described in the second embodiment, a pair of brake cams 70 and 71 are arranged on a brake shaft 74 to alternately frictionally engage the face gear 330 thereby constraining it from rotation and releasing the face gear 340 so that it is free to rotate, then to frictionally engage the face gear 340 and release the face gear 330. When a face gear is constrained from rotation in this way, its corresponding potentiometer is electrically switched out of the closed loop servo circuit and the other potentiometer is switched in.

In operation, the device of the third embodiment functions quite similarly to that of the second embodiment. As power is applied to the actuator 300, the housing 312 is caused to rotate about the fixed shaft 310. As the housing 312 moves about the axis of the shaft 310, so does the stud 316 and the gear 318. When the face gear 330 is constrained from movement by the brake cam 70, the gear 318 simply rotates as its teeth are made to engage successive teeth of the stationary face gear 330. The face gear 340, however, will rotate in the same direction as the rotating actuator housing 312 thereby imparting movement to the push rod 50. This movement continues until the feed mechanism is positioned as desired. Subsequently, the face gear 340 is constrained from movement by the brake cam 72 and the face gear 330 released so that the needle bar gate may be positioned in a similar manner.

Figure 4:
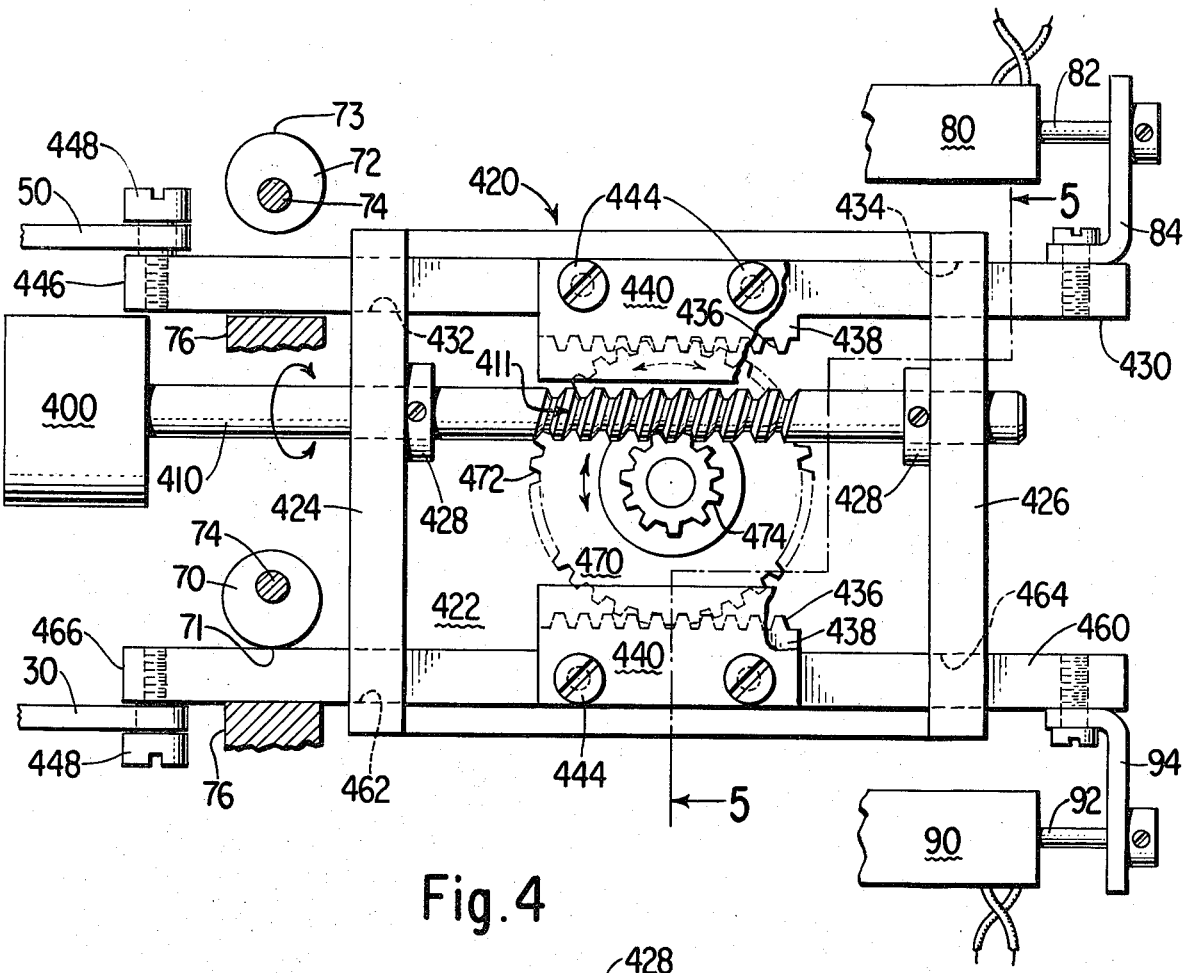
FIG. 4 is a plan showing still another embodiment of the present invention.
Figure 5:
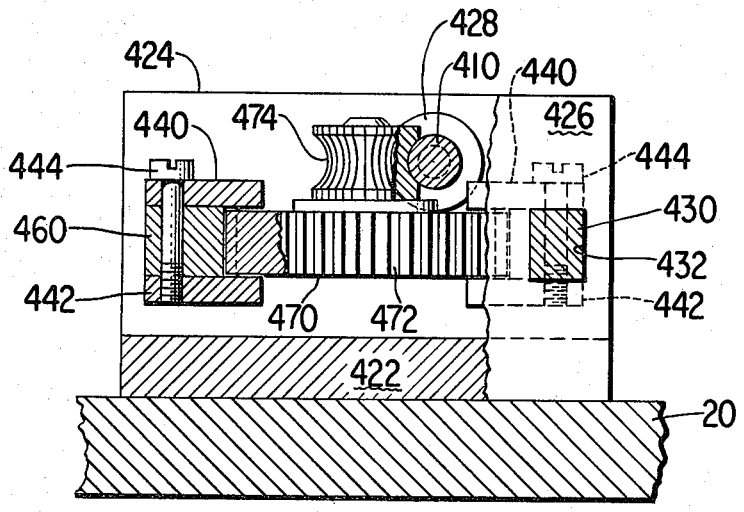
FIG. 5 is a section view taken along lines 5—5 in FIG. 4.
Figure 6:
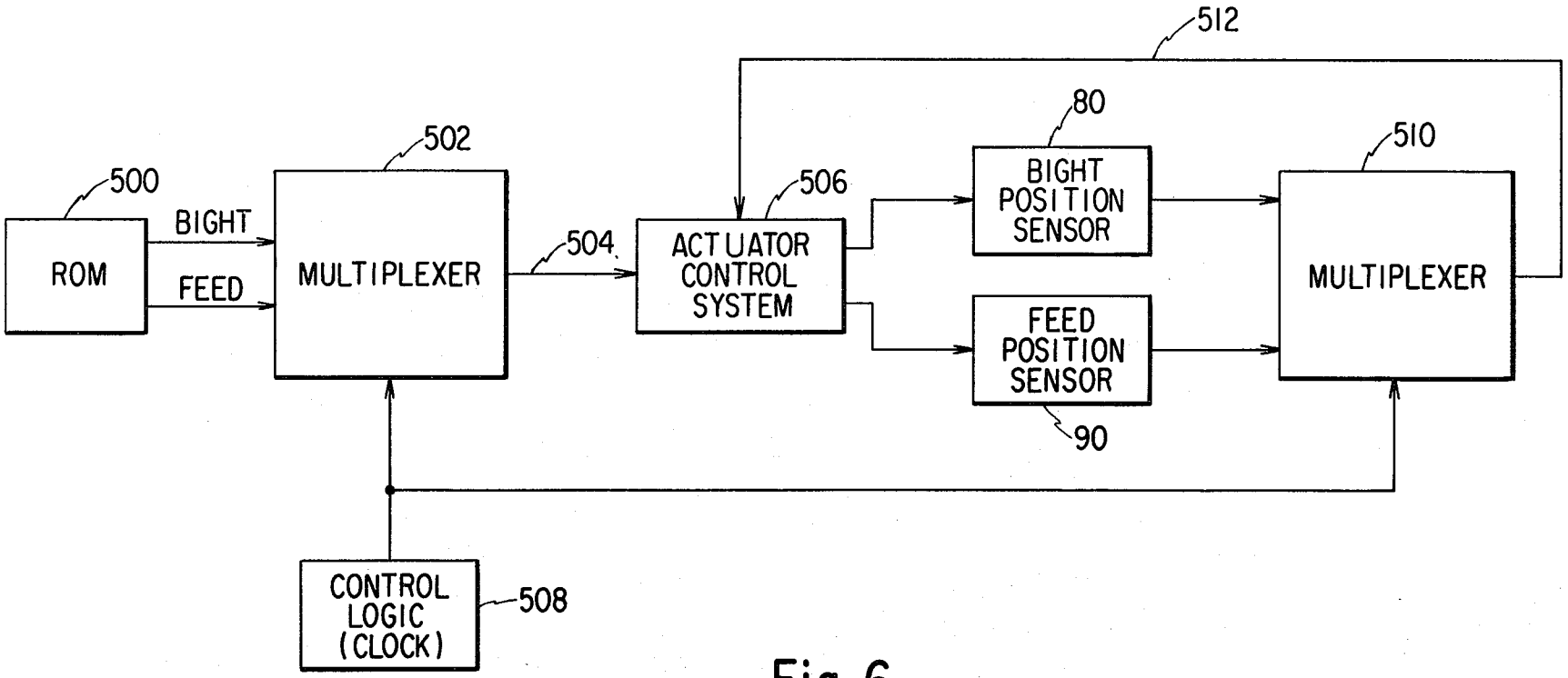
FIG. 6 is a block diagram showing the control logic associated with the present invention.

A fourth embodiment of the present invention is depicted in FIGS. 4 and 5. A U-shaped bracket 420 having a base portion 422 and two side portions 424 and 426 is secured to the frame 20 with suitable fasteners. A motor 400, attached to the frame 20 with suitable fasteners, has an armature shaft 410 which is journalled in both side portions 424 and 426 and projects therethrough. A pair of collars 428 are arranged to limit end play of the shaft 410. The surface of the shaft 410 has a worm 411 formed therein substantially midway the pair of collars 428. A rack bar 430, having a rectangular cross section, is slidingly supported in perforations 432 and 434 formed in the side portions 424 and 426, respectively. Rack teeth 436 have been formed in a raised portion 438 of the rack bar 430. A pair of plates 440 and 442 straddle the rack teeth 436 and are fastened to the rack bar 430 by screws 444 which are threaded into the plate 442. The push rod 50 is pivotally attached to the extremity 446 of the bar 430 by shoulder screw 448. Similarly, a second rack bar 460 of like construction is slidingly supported in perforations 462 and 464 formed in the side portions 424 and 426, respectively. A pair of plates 440 and 442 straddle the rack teeth 436 and are fastened to the rack bar 460 similar to the rack bar 430. Additionally, the push rod 30 is pivotally attached to the extremity 466 of the bar 460 by the shoulder screw 448.

The perforations 432, 434 and 462, 464 are aligned so that the rack bars 430 and 460 are free to slide in a direction parallel to the axis of the armature shaft 410 and so that the teeth 436 of the rack bars operationally engage the teeth 472, on opposite sides, of a gear 470 as shown in FIG. 4. The width of the gear 470 is such that it loosely fits between each pair of plates 440, 442 and is held captive therebetween. A worm gear 474, formed in the hub of the gear 470, operationally engages the worm 411 of the armature shaft 410.

As described in the first embodiment, a pair of brake cams 70 and 72 are arranged on a brake shaft 74 in cooperation with a pair of pressure pads 76 to alternately wedgingly engage the rack bar 460 thereby constraining its motion while releasing the rack bar 430 so that it is free to slide, then to wedgingly engage the rack bar 430 and release the rack bar 460. Additionally, a pair of position sensors 80, 90, each having a wiper actuated by rods 82, 92, are rigidly mounted to the frame 20 by suitable fasteners. A pair of angle brackets 84, 94, one rigidly mounted to the push rod 30 and the other mounted to the push rod 50 are arranged to operatively engage the wiper rods 82, 92 of the position sensors 80 and 90.

In operation, the device of the fourth embodiment functions similarly to those of the other embodiments. As power is applied to the actuator 400 the worm 411 is caused to rotate thereby causing the worm gear 474 and attached gear 470 to rotate. When the rack bar 460 is constrained from sliding motion by the brake cam 70, as shown in FIG. 4, the gear 470 simply rotates as its teeth are made to engage successive teeth of the stationary rack teeth 436 of the bar 460. This causes the gear 470 to be laterally displaced. Since the teeth 472 of the gear 470 also are in engagement with the rack teeth 436 of the bar 430, the rack bar 430 is caused to be laterally displaced in proportion to the displacement of the gear 470 and thereby imparting movement to the push rod 50. This movement continues until the feed mechanism is positioned as desired. Subsequently, the rack bar 430 is constrained from sliding motion by the brake cam 72 and the rack bar 460 released so that the needle bar gate may be positioned in a similar manner. As the push rods 30 and 50 move longitudinally, so do their respective wiper rods 82, 92 thereby generating positional data for both push rods. This positional data is then fed back to the closed loop servo system for controlling the actuator 400.

While in the above descriptions the push rods 30 and 50 are connected to a needle bar gate for controlling lateral jogging of the needle and to the feed mechanism to control the rate of feed of the work material, it is expressly understood that the push rods 30 and 50 may be connected to any stitch forming instrumentality that may be controlled by a specific motion.

Upon reviewing the present disclosure, a number of alternative constructions will occur to one skilled in the art. Such constructions may utilize various differential bar or differential gear arrangements or may control more than two stitch forming instrumentalities and are considered to be within the spirit and scope of this invention.

We claim:

1. An electronically controlled stitch pattern sewing machine including an electronic memory means for storing stitch pattern data, a plurality of stitch forming instrumentalities at least two of which are each positionally controllable over a predetermined range;

a single actuator responsive to the data content of said memory means for effecting movement;

a plurality of coupling means for imparting selected predefined movements to said at least two of said controllable stitch forming instrumentalities;

control means for selectively and individually connecting said single actuator to each of said coupling means; and means for selecting and applying specific data content stored in said electronic memory to said single actuator when said control means individually connects said single actuator to each different one of said plurality of coupling means;

whereby said selected predefined movements are effected by said single actuator.

2. A sewing machine as set forth in claim 1 wherein said memory means is subdivided into a plurality of data blocks, each of said data blocks containing stitch pattern data representing specific predefined movements of said controllable stitch forming instrumentalities.

3. A sewing machine as set forth in claim 2 wherein a unique one of said plurality of said data blocks is associated with each of said controllable stitch forming instrumentalities whereby the data stored in any one of said data blocks represents said movement of one and only one of said controllable stitch forming instrumentalities.

4. A sewing machine as set forth in claim 3 wherein said control means includes a differential gear arrangement.

5. A sewing machine as set forth in claim 3 wherein said control means includes an elongated bar having two extremities, a pivot point at each of said extremities for pivotally connecting said bar to one of said plurality of coupling means, and pivotal means interposed between said two extremities for operationally connecting said elongated bar with said single actuator.

6. A sewing machine as set forth in claim 3 wherein said control means includes a gear arranged for rotation and having an axis of rotation, said gear further arranged for back and forth linear movement in a direction perpendicular to said axis of rotation, a pair of rack gears each of which is in operational engagement with said gear, said pair of rack gears being disposed on opposite sides of said gear and arranged for back and forth linear movement in a direction parallel to said direction of linear movement of said gear, said pair of rack gears each being operationally connected to a different one of said plurality of coupling means, and rotary drive means for operationally connecting said gear with said single actuator.

7. A sewing machine as set forth in claim 3 wherein said actuator is a linear actuator.

8. A sewing machine as set forth in claim 3 wherein said actuator is a rotary actuator.

9. A sewing machine as set forth in claim 3 wherein said control means includes a plurality of brake means associated with and having a one-to-one correspondence with said plurality of coupling means for selectively rendering ineffective at least one of said coupling means for effecting said predefined movements.

10. A sewing machine as set forth in claim 3 wherein said control means includes a plurality of position sensing devices associated with and having a one-to-one correspondence with said plurality of coupling means for sensing the position of said controllable stitch forming instrumentalities.

* * * * *